US007644720B2

(12) United States Patent
Chen

(10) Patent No.: US 7,644,720 B2
(45) Date of Patent: Jan. 12, 2010

(54) RETRACTABLE ROD AND TENT

(76) Inventor: Xiangnian Chen, Room 304, Unit 1, Block 2, No. 161, Xiamei Road, Zhuhai, Guangdong (CN) 519000

( * ) Notice: Subject to any disclaimer, the term of this patent is extended or adjusted under 35 U.S.C. 154(b) by 22 days.

(21) Appl. No.: 12/177,873

(22) Filed: Jul. 22, 2008

(65) Prior Publication Data

US 2008/0271770 A1 Nov. 6, 2008

Related U.S. Application Data

(63) Continuation of application No. PCT/CN2007/000238, filed on Jan. 23, 2007.

(30) Foreign Application Priority Data

Jan. 24, 2006 (CN) ..... 2006 1 0033289
Jul. 19, 2006 (CN) ..... 2006 1 0036648

(51) Int. Cl.
*E04H 15/46* (2006.01)
*E04H 15/60* (2006.01)

(52) U.S. Cl. ..... 135/135; 135/91; 135/127; 135/147; 135/114; 174/50; 174/84 R

(58) Field of Classification Search ..... 135/91, 135/98, 123, 127, 135, 141–142, 147, 156, 135/114; 248/288.8, 160; 74/502.5; 403/56, 403/90, 270; 174/50, 84 R, 90
See application file for complete search history.

(56) References Cited

U.S. PATENT DOCUMENTS

| | | | | |
|---|---|---|---|---|
| 2,510,198 | A * | 6/1950 | Tesmer | 248/229.25 |
| 3,096,962 | A * | 7/1963 | Meijs | 248/276.1 |
| 3,529,797 | A * | 9/1970 | Street | 248/160 |
| 4,202,363 | A * | 5/1980 | Watts et al. | 135/98 |
| 5,023,756 | A * | 6/1991 | Regester | 362/16 |
| 5,348,259 | A * | 9/1994 | Blanco et al. | 248/276.1 |
| 5,590,674 | A * | 1/1997 | Eppenbach | 135/114 |
| 7,311,664 | B2 * | 12/2007 | Goodman et al. | 600/228 |
| 7,497,603 | B2 * | 3/2009 | Malkanov | 362/355 |

* cited by examiner

*Primary Examiner*—Winnie Yip

(57) ABSTRACT

The invention relates to a retractable rod and a tent made from the rod. The retractable rod comprises a multitude of rigid skeleton joints having two axial end surfaces and side surfaces. The joints are connected through the convex-concave connection by two flexible ropes passing through the holes of the joints to form a rod. There is a storage compartment locating at one end of the rod which winds and stores the rod therein. The storage compartment comprises a shaft, a rod storage sleeve which is in an intermittent drive mode fixed to the shaft; one end of the two flexible ropes passes through the rod storage sleeve and is fixed to the shaft. The rod storage sleeve is supported and rotates between two rope-protecting boards. A tension part locates at the other end of the rod and the other end of the two flexible ropes is fixed to the tension part. The advantage of the invention is that the tent made from the retractable rod occupies a small storage space.

18 Claims, 22 Drawing Sheets

RETRACTABLE ROD AND TENT

CROSS REFERENCE TO RELATED APPLICATIONS

This application is a Continuation-In-Part of international application PCT/CN2007/000238, filed Jan. 23, 2007, which claims priority from Chinese patent applications 200610033289.2 filed on Jan. 24, 2006 and 200610036648.X filed on Jul. 19, 2006. These two applications are incorporated herein by reference.

The invention relates to a retractable rod and a tent made thereof.

BACKGROUND OF THE INVENTION

Some temporary structures such as advertising posters and tents can be taken apart and reassembled. Their frames are usually made of rods and joints. Advertising posters or tent tarpaulins are attached to the frame by gripping or other ways. Such structures occupy a reduced space after being disassembled. However, the rods require a certain length, and thus the space reduction in these structures after being disassembled is not significant.

Chinese patent No. CN1027657C discloses a backbone type tent frame which consists of several plastic or metal tubes. These tubes are connected with a wire, forming an arc, triangle, or other polygonal shape. When the wire is loosened the tubes can be folded up. Using such rods, the frame to support a tent can be formed. The frame or tent of such a design can further reduce the volume. However, its use is still complicated by multiple steps in operation. Particularly, when the rods are relatively long, they are easily disorganized after being folded up, causing inconvenience for reassembling.

SUMMARY OF THE INVENTION

The main object of the invention is to provide rods which are easily retractable and restored in an orderly fashion.

Another objective of the invention is to use such retractable rods to make a tent.

To recognize these objectives, the retractable rod of the invention comprises a multitude of rigid skeleton joints with two axial ends and sides. One end of the joint is a convex shape and the other end is a concave shape. The convex of one joint connects with the concave of an adjacent joint. Each joint has two axial through holes and all joints are connected in series along the through holes by two flexible ropes. In addition, there is a storage compartment which is located at an end of the retractable rod to wind the retractable rod and store wherein. The storage compartment has a shaft. A rod storage sleeve is linked by an intermittent driving mode to an end of the shaft. One end of the ropes passes through the rod storage sleeve and ties to the shaft. The rod storage sleeve rotationally supports two rope-protecting boards. A tension part is provided at another end of the rod; another end of the two ropes is fixed on the tension part.

One embodiment of the invention is to design the intermittent driving mode that links the shaft and the rod storage sleeve as a pair of gears. By this way, when the shaft rotates clockwise, it drives the rod storage sleeve; when the shaft rotates counterclockwise, it gives 360° intermittence. When the gears rotate in opposite directions, the shaft drives the rod storage sleeve to rotate counterclockwise, vice versa.

Another embodiment is to design the tension part to have a support foot and an elastic structure linked between the ends of the ropes and the support foot. When the rope is stretched, the elastic structure is tensed, and the rod becomes rigid. When the rope is relaxed, the rope under the resilience of the elastic structure relaxes the restriction on the joints so that they can be folded up and conveniently stored.

To use the rigid rod in a curved shape, the surfaces of the joints can be designed to have a certain angle and make the axes of the convex and concave vertical over the surface. This forms curvatures in some joints. The degree of the angle and the number of the curved joints can be determined by the desired radian of the rod.

Another retractable rod of the invention comprises rigid joints that have two axial end surfaces and sides. One axial end of each joint has a convex and the other axial end has a concave which matches with the convex. Each joint has two or more axial through holes. All joints are organized by convex-concave manner and connected by two or more ropes which pass the through holes to form a rod. In addition, there is a storage compartment located at one end of the retractable rod to wind and store the retractable rod therein. The storage compartment comprises a shaft, a rod storage sleeve which is set outside the shaft and can rotate relative to the shaft, and two or more ropes, one end of which passes through the rod storage sleeve and fixes to the shaft. The storage sleeve can rotate and support between two rope-protecting boards.

One embodiment is that between the convex and concave of two adjacent joints are set an elastic part which can separate the convex and concave.

More particularly, the elastic part is a spring.

To use the rigid rod in a curved shape, the surfaces of the joints can be designed to have a certain angle and make the axes of the convex and concave vertical over the surface. This forms curvatures in some joints. The degree of the angle and the number of the curved joints can be determined by the desired radian of the rod.

The tent made from the retractable rods of the invention comprises a tarpaulin which can form the space of the tent and three and more retractable rods which form the support of the tent. The tarpaulin is attached to the rods and can be retracted together with the rods. Thus, when the rods are in a rigid state, the tarpaulin opens to form a tent; when the rods are in a relaxed state, the tarpaulin retracts with the rods.

An embodiment is to design a power input shaft to receive force; the power input shaft, through a transmission mechanism, drives the shafts of all retractable rods to rotate simultaneously. Thus, rotating the power input shaft can conveniently open or retract the tent.

More particularly, the power input shaft is controlled by an electrical motor which opens or retracts the tent. Also, the transmission mechanism is a gear system. One of the gears has a locking mechanism which can stop all other gears. Thus, when the rods retract to a position or open to a position to make the rods rigid, the entire system is locked to avoid any undesired retraction or opening of the tent.

The above locking mechanism comprises a magnetic locking bar and locking teeth surrounding a gear shaft. The locking bar and locking teeth are controlled by magnet. When the bar and the teeth are meshed, the entire system is locked. When the bar and the teeth are separated, the transmission system, driven by the motor, opens or retracts the tent.

Furthermore, the tent can have a control panel which is equipped with flare and remote control receiver. This make more convenient to operate the tent and use it in night.

The tent made from another type of retractable rods of the invention comprises a tarpaulin which can form a space of the tent and three or more retractable rods which form the support of the tent. The tarpaulin is attached to the rods and can be retracted together with the rods. Thus, when the rods are in the rigid state, the tarpaulin opens to form a tent; when the rods are in the relaxed state, the tarpaulin retracts with the rods.

An embodiment is to design a power input shaft driven by motor; the power input shaft is linked through a transmission mechanism to the rod storage sleeves; each shaft is driven by a separate motor.

More particularly, each shaft is set up with a gear and a locking mechanism that can lock the gear.

The locking mechanism comprises a magnetic locking bar; the locking bar and the locking teeth of the gear are controlled by magnet.

Also, the tent is set up with a control panel which is equipped with a flare and a remote control receiver.

The following embodiments further illustrate the invention.

DESCRIPTION OF THE PREFERRED EMBODIMENTS

Embodiment 1 of Retractable Rod

Figure 1:
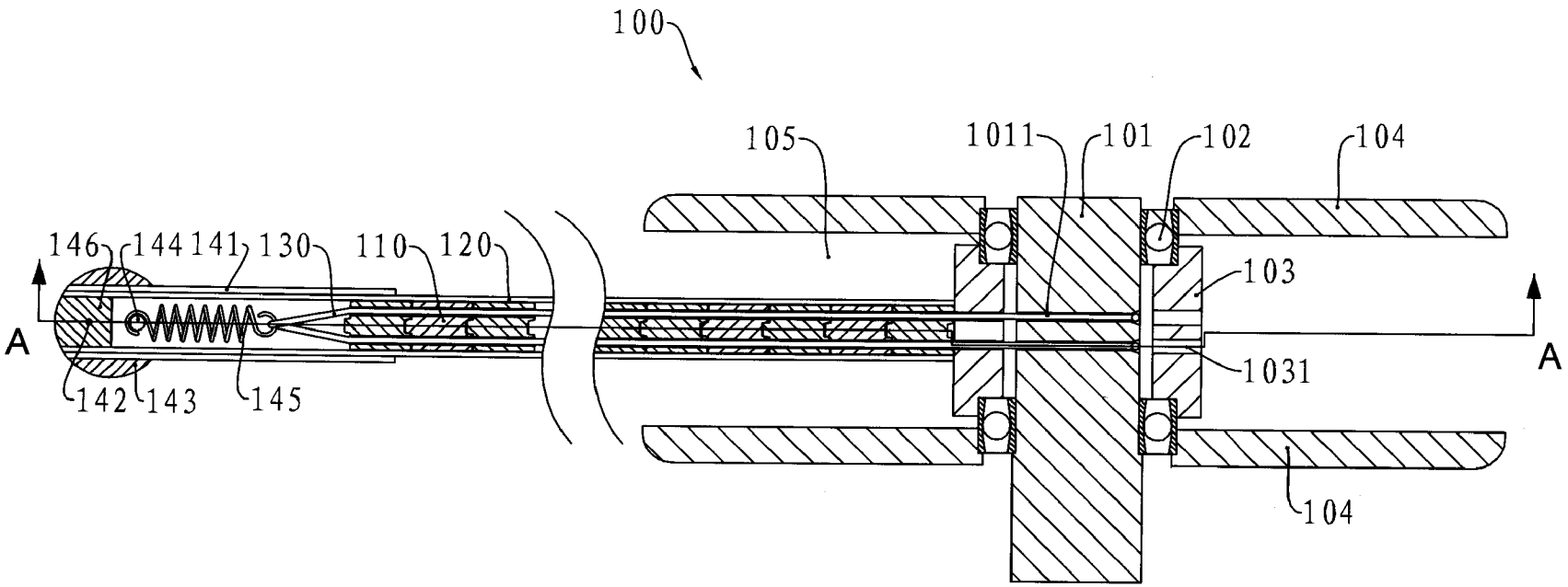
FIG. 1 is a perspective view of the retractable rod of embodiment 1 of the invention.

See FIG. 1, retractable rod 100 is made of a multitude of rigid skeleton joints 110. The concave and convex surfaces of the joints are connected along the through holes by two flexible ropes 130. The two ropes can form a circle and become one rope 130. The storage compartment comprises a shaft 101 which is in an intermittent driving mode and fixed onto a rod storage sleeve 103 and a pair of rope-protecting boards 104. Two rope-protecting boards form a storage space 105. In this embodiment, rod storage sleeve 103 is linked to the rope-protecting boards 104 through bearing 102. Ropes 130 pass through rod storage sleeve 103 and are then fixed to shaft 101. The other end of ropes 130 is fixed to a tension part. The tension part comprises a support leg and a spring 145. Alternatively, the spring 145 can be replaced by a rubber bend. The support leg comprises rigid tube 141, caulking 146, foot 143 and pin 142; pin 142 is used to link foot 143, tube 141 and caulking 146; spring 145 is linked to rope 130 through pin 144. Soft tube 120 is able to slide along the outside of rigid joints 110, an end of which is fixing to pin 142 and the other end is left free.

Figure 2:
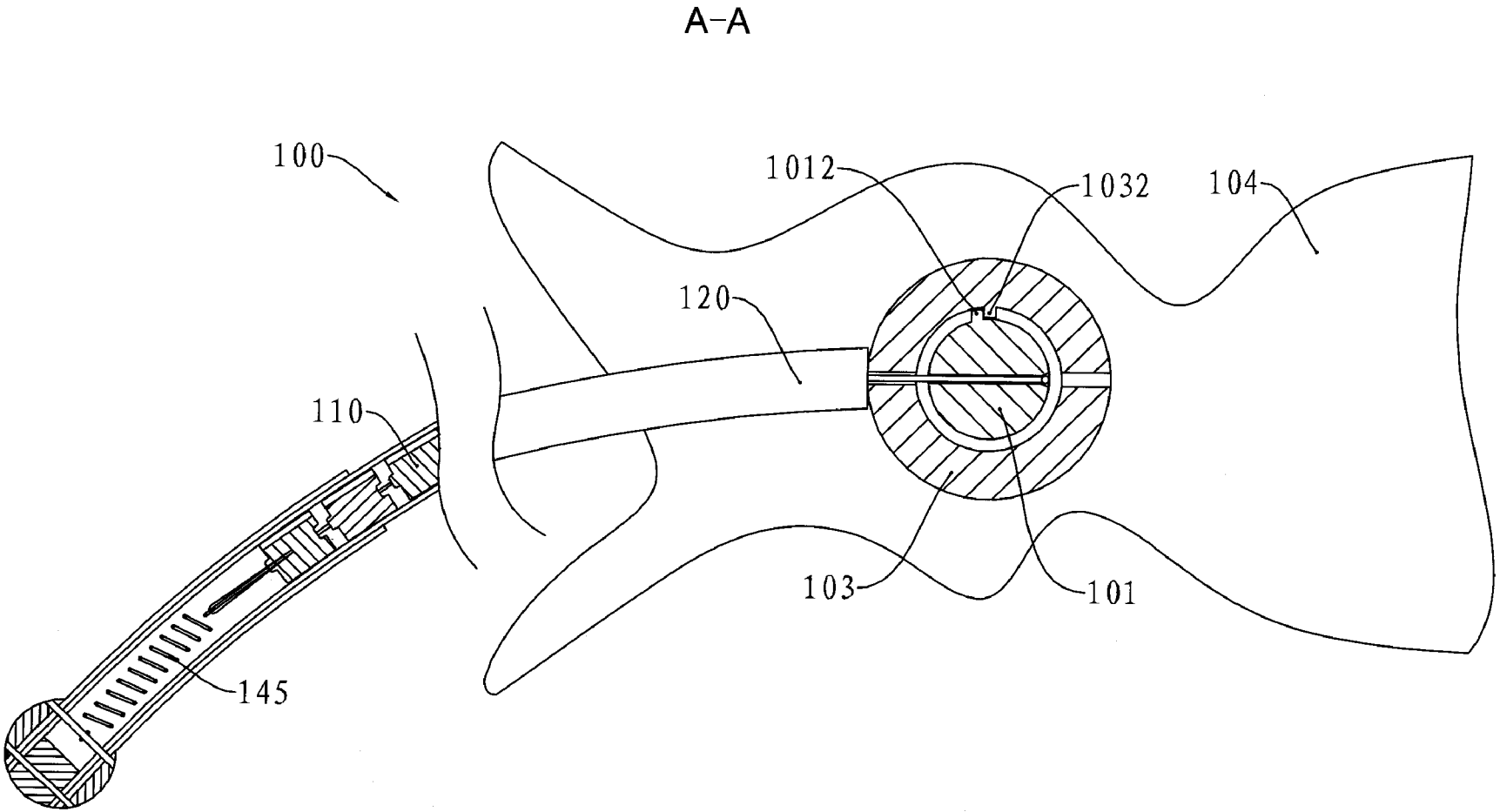
FIG. 2 is an A-A sectional view of FIG. 1.

See FIG. 2, rod storage sleeve 103 and shaft 101 are linked by gears 1012 and 1032. The rod showed in FIG. 2 is in its released state; at the same time, the spring is in relaxing state.

Embodiment 2 of Retractable Rod

Figure 3:
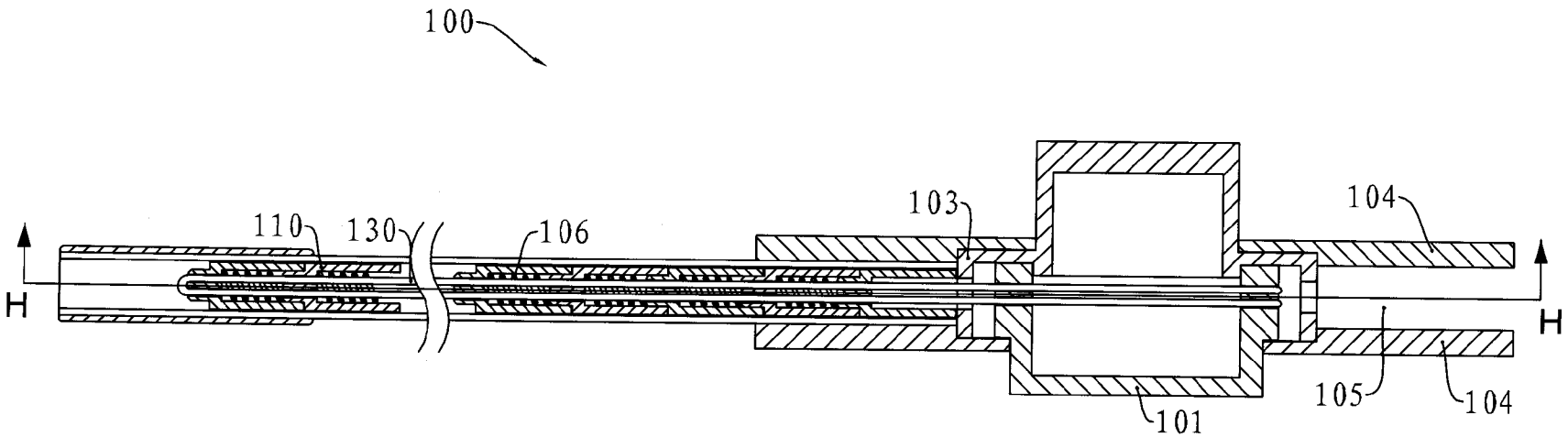
FIG. 3 is a perspective view of the retractable rod of embodiment 2 of the invention.

See FIG. 3, retractable rod 100 comprises a multitude of rigid skeleton joints which are concave-convex connected in series through rope 130; rope 130 forms a circle. Storage compartment comprise shaft 101 which can revolve around rope-protecting boards 104, rod storage sleeve 103 which can rotate around shaft 101, and storage space 105 formed by rope-protecting boards 104. In this embodiment, rod storage sleeve 103 is linked to rope-protecting boards 104 in a revolving mode. One end of ropes 130 passes through rod storage sleeve 103 and fixes to shaft 101. The other end of ropes 130 is fixed to the other end of the retractable rod. Between the canvas and convex of two adjacent skeleton joints, there is a spring 106. The retractable rod shown in FIG. 3 is in a rigid state, i.e., rope 130 is in a tension state and spring 106 is in a pressured state. In addition, this embodiment differs from embodiment 1 in that in this embodiment, rod storage sleeve 103 and shaft 101 are driven independently, i.e., one force drives rod storage sleeve 103 to rotate and control the rod in and out, and another force drives the shaft 101 to rotate to pull or release the rope.

Figure 4:
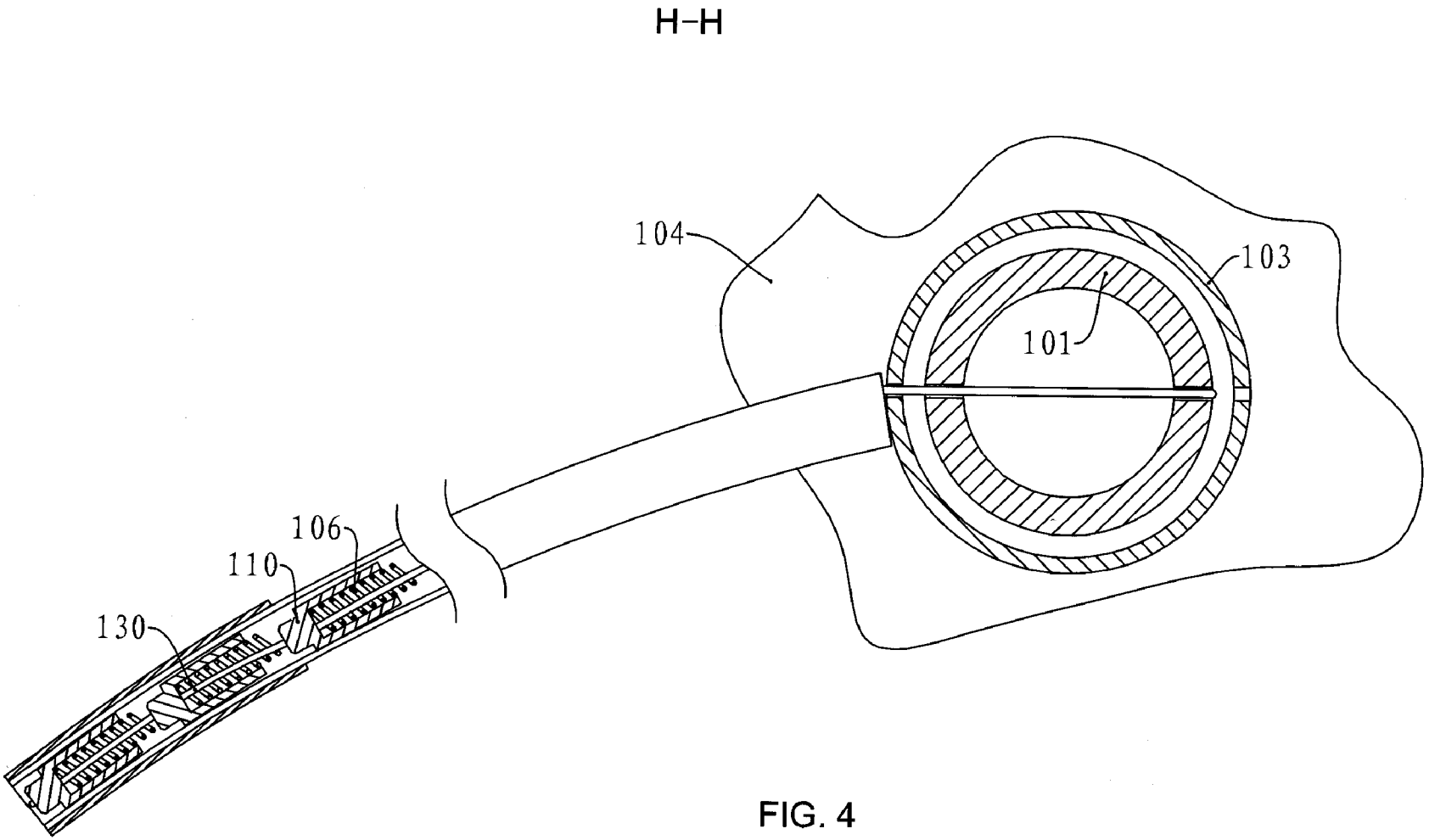
FIG. 4 is an H-H sectional view of FIG. 3.

See FIG. 4, rod storage sleeve 103 and shaft 101 rotate against rope-protecting boards 104 driven by independent forces. The rod shown in FIG. 4 is in a relaxing state where spring 106 and the rope both are in a relaxing state; adjacent skeleton joints under the resilience of spring 106 release the convex-concave connection and thus the joints can be folded up.

Figure 5:
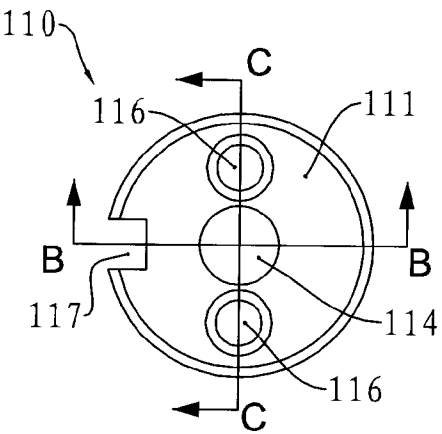
FIG. 5 is a perspective view of the joints of the retractable rod of embodiment 1.

See FIG. 5, this figure shows rigid joint 110, an enlarged sectional view of end surface 111. Through this end surface, one can see a pair of holes 116, a concave 114, and a connecting trough 117.

Figure 6:
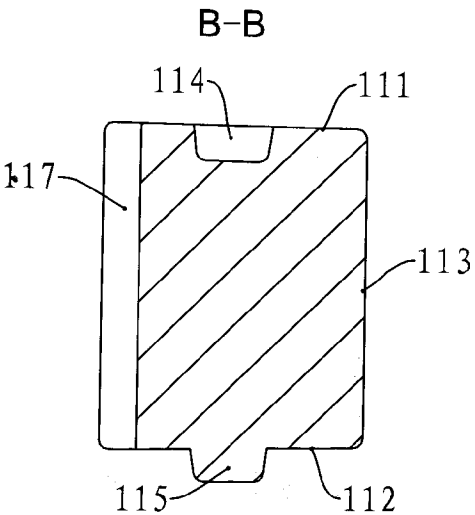
FIG. 6 is a B-B sectional view of FIG. 5.

See FIG. 6, the rigid joint is formed by end surfaces 111 and 112 and side surfaces 113. One end surface has a concave 114 and the other end surface has a convex 115; convex 115 and concave 114 match with each other; adjacent joints are thus connected each other through the convex and concave shapes. To set up the rod straight, the end surfaces 111 and 112 of each joint are set parallel to each other; to set up the rod curvedly, in the place of curvature, end surfaces 111 and 112 can be design to have an angel; this makes convex 115 vertical to end surface 112, and makes concave 114 vertical to end surface 111. In order to prevent the curved joints from being connected in an opposite way, the adjacent joints are not only connected in the convex-concave connection but also set up to have the same direction as connecting trough 117 (see FIG. 2).

Figure 7:
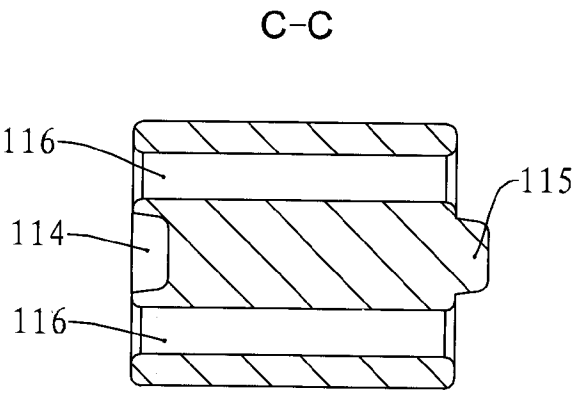
FIG. 7 is a C-C sectional view of FIG. 5.

See FIG. 7, two holes 116 of the joints are set parallel to the flank of convex 115 and concave 114.

Figure 8:
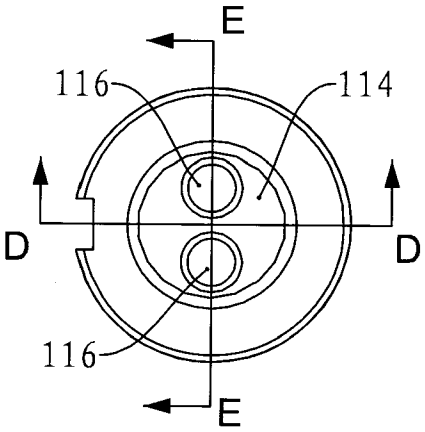
FIG. 8 is a perspective view of the joints of another embodiment.
Figure 10:
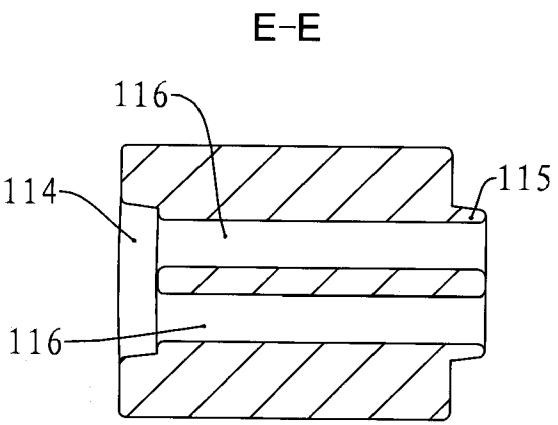
FIG. 10 is an E-E sectional view of FIG. 8.
Figure 9:
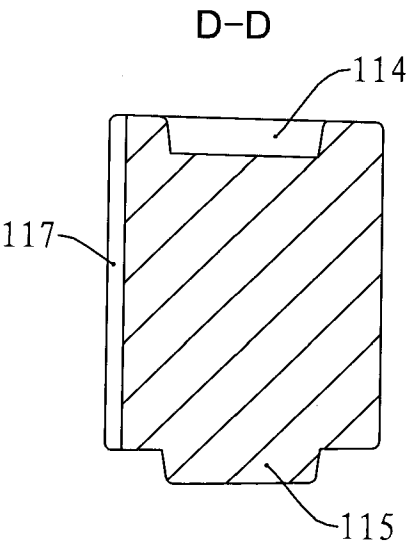
FIG. 9 is a D-D sectional view of FIG. 8.

See FIGS. 8, 9 and 10, these figures show the structure of another embodiment of the rigid joints. The markings of these figures are the same as those in the above embodiments. The difference is that in this embodiment, two holes 116 are set parallel and placed inside convex 115 and concave 114.

Figure 11:
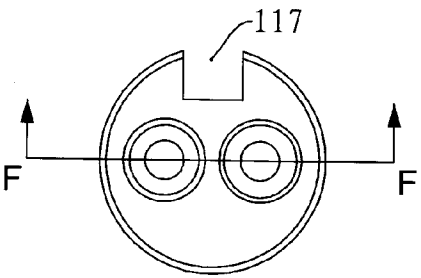
FIG. 11 is a perspective view of still another joint.
Figure 12:
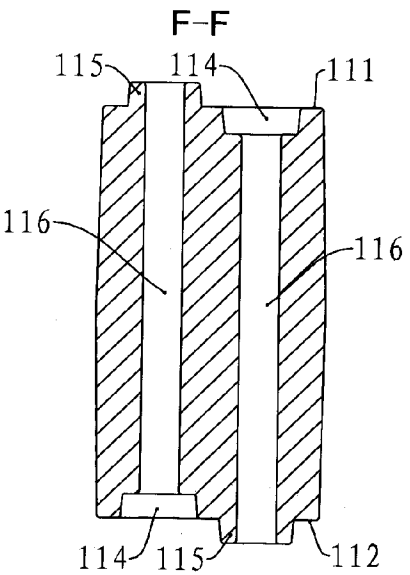
FIG. 12 is an F-F sectional view of FIG. 11.

See FIGS. 11 and 12, these figures show an additional embodiment of the structure of the rigid joints. The markings of these figures are the same as those in the above embodiments. The unique feature of this embodiment is that each of end surfaces 111 and 112 of the joints has a convex 115 and a concave 114 and two holes 116 pass parallel through convex 115 and concave 114, respectively.

Figure 13:
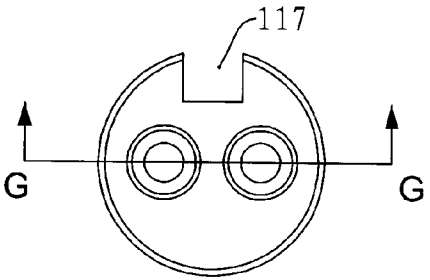
FIG. 13 is a perspective view of still another joint.
Figure 14:
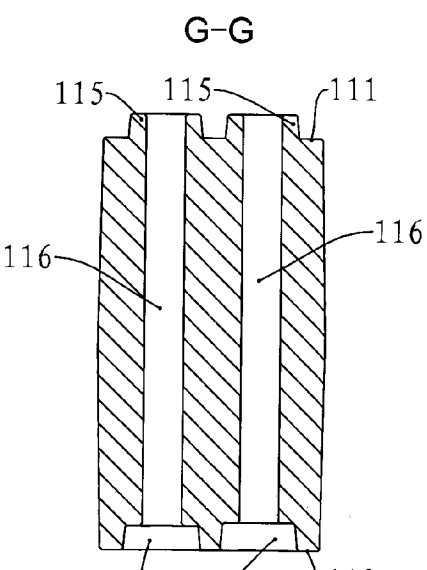
FIG. 14 is a G-G sectional view of FIG. 13.

See FIGS. 13 and 14, these figures show a still additional embodiment of the structure of the rigid joints. The markings of these figures are the same as those in the above embodiments. The unique feature of this embodiment is that each of end surfaces 111 and 112 of the joints has two convexes 115 or two concaves 114 and two holes 116 pass parallel through one convex 115 and one concave 114, respectively.

Figure 16:
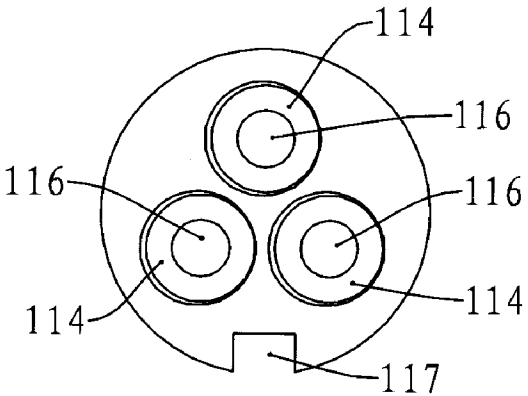
FIG. 16 is a bottom view of FIG. 15.
Figure 17:
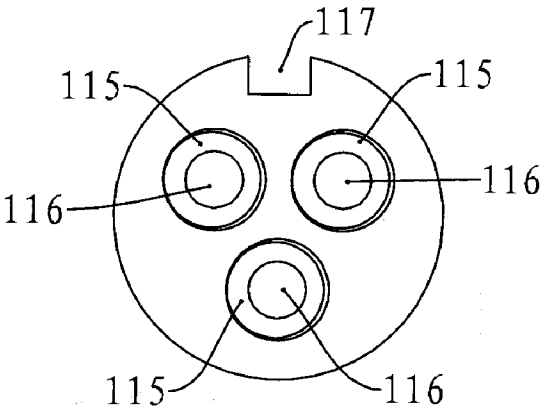
FIG. 17 is a top view of FIG. 15.
Figure 15:
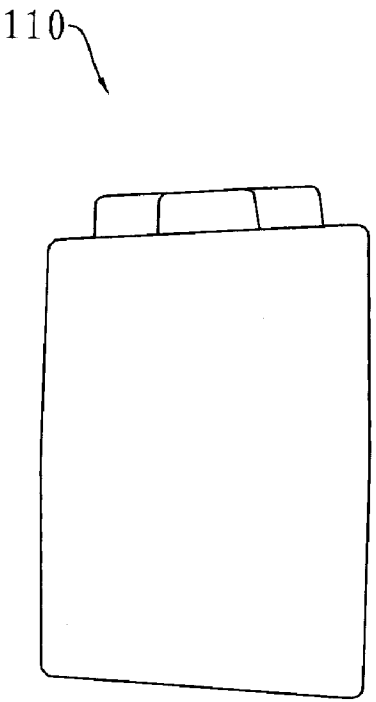
FIG. 15 is a perspective view of still another joint.

See FIGS. 15, 16 and 17, these figures show still another embodiment of the structure of the rigid joints. The markings of these figures are the same as those in the above embodiments. The unique feature of this embodiment is that each of end surfaces 111 and 112 of the joints has three convexes 115 or concaves 114 and three holes 116 that pass through parallel one convex 115 and one concave 114, respectively.

There are still more possible embodiments of the retractable rod of the invention. For instance, there can be four holes 116, five holes 116, or even more holes 116, and there can be provided with the same number of flexible ropes.

Figure 18:
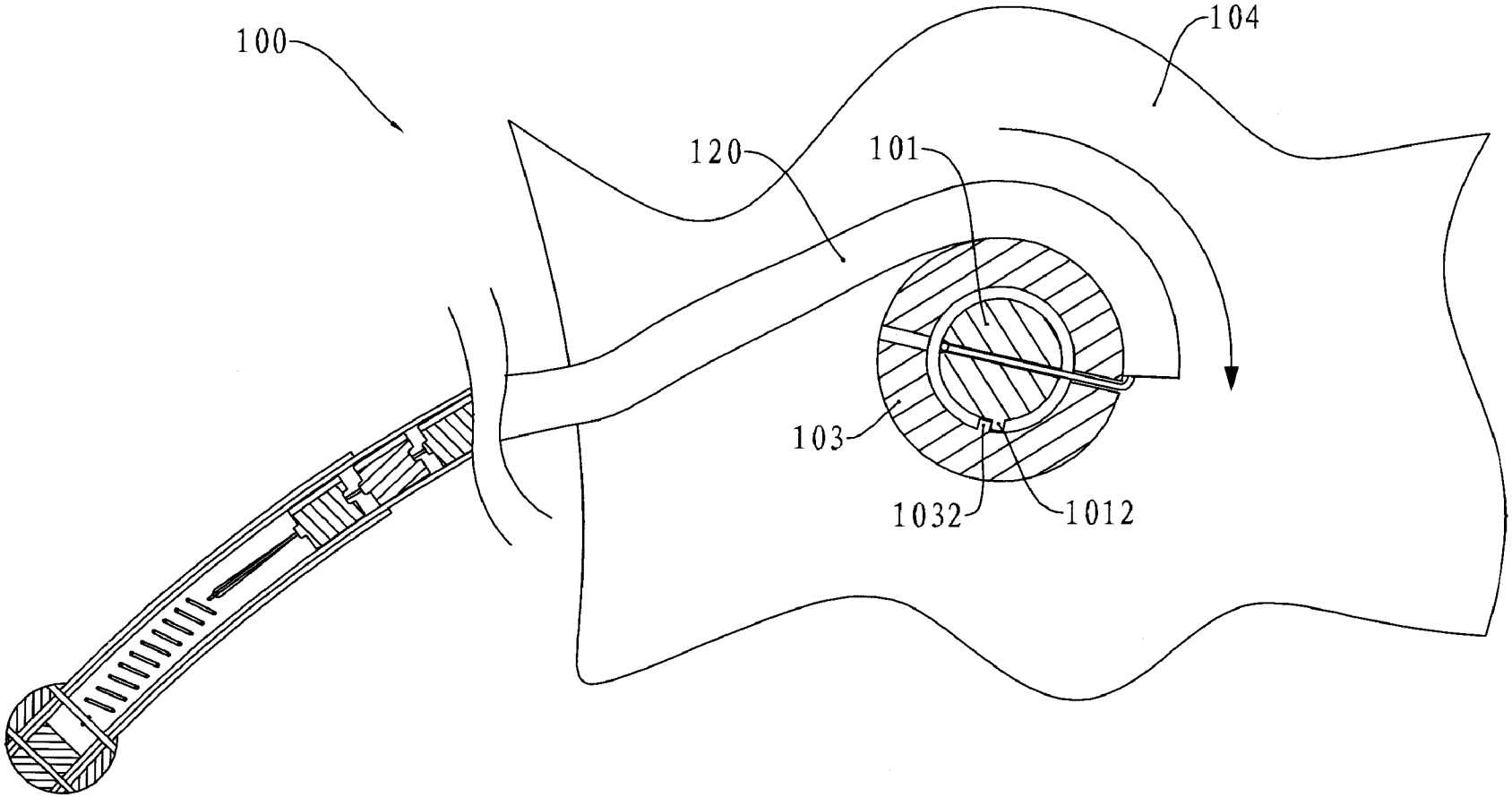
FIG. 18 is a perspective view showing the retraction of the rod of embodiment 1.
Figure 19:
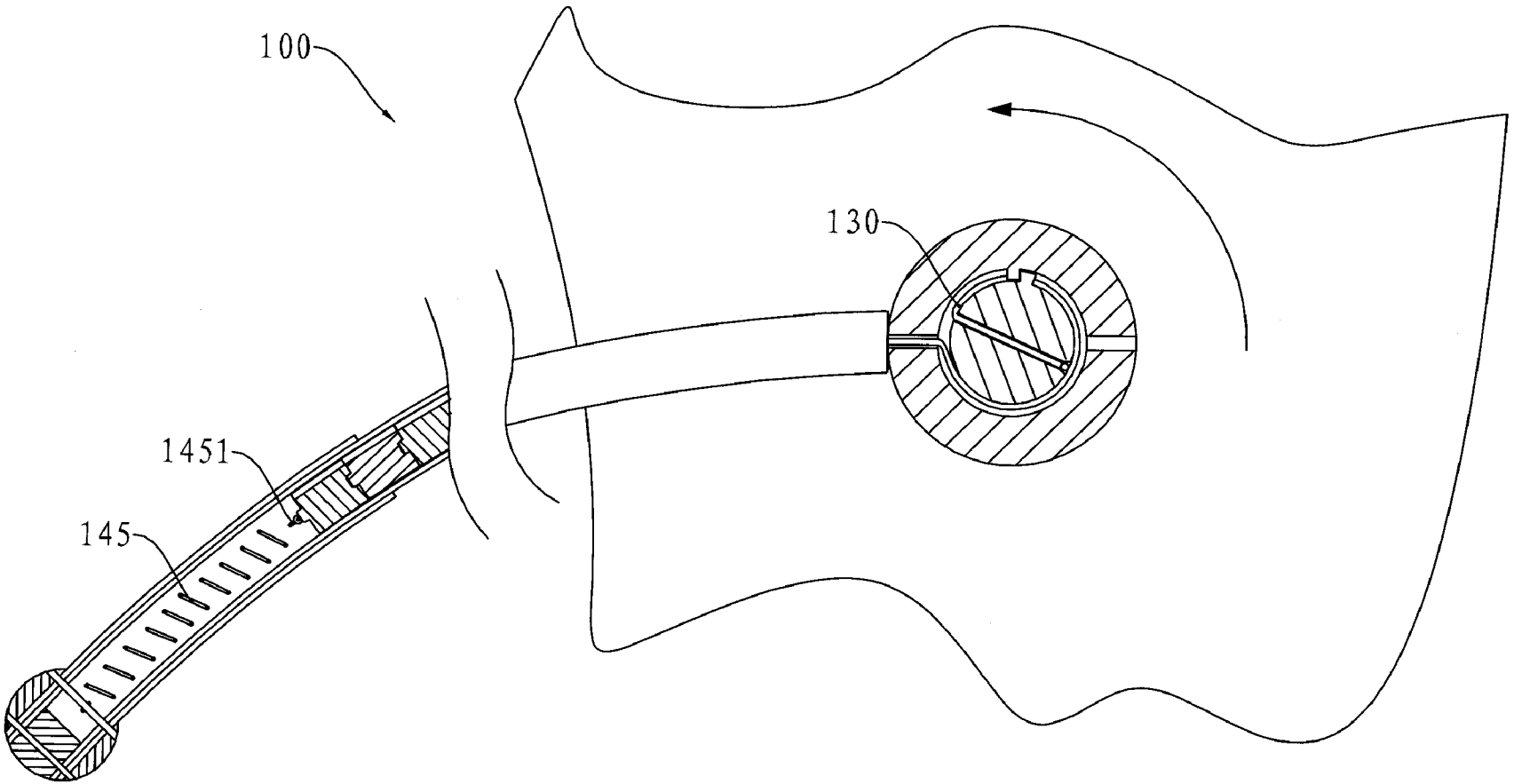
FIG. 19 is a perspective view showing that the rod of embodiment 1 is stretched and becomes rigid.

The following description explains the working mechanism of embodiment 1. See FIG. 18, when shaft 101 rotates clockwise by following the arrow direction in FIG. 18, gear 1012 drives gear 1032 to rotate, and gear 1032 then drives rod storage sleeve 103 to rotate. This allows soft tube 120 and inside rigid joints 110 through the convex-concave connection enter into between two rope-protecting boards 104 until the end surface of rigid tube 141 is about to enter; the spring is tensed; and the retraction process is finished. The releasing process of the rod is as follows. In the above retracted state, when shaft 101 rotates counterclockwise by following the arrow direction of FIG. 19, an intermittent transmission occurs. First, gear 1012 departs from gear 1032, and the gear idles. That is, rod storage sleeve 103 does not rotate. The flexible rope, under the resilience of spring 145, slides along the joints through the holes. When shaft 101 rotates about 360°, gear 1012 drives gear 1032 and gear 1032 drives rod storage sleeve 103 to rotate counterclockwise. At this time, soft tube 120 is released from the rope-protecting boards until it reaches the state illustrated in FIG. 2. The shaft continues rotating counterclockwise, which pulls the flexible rope until the top end 1451 of spring 145 reaches the joint and pushes the convex and concave of the joints tightly against each other. This forms a rigid rod.

Figure 20:
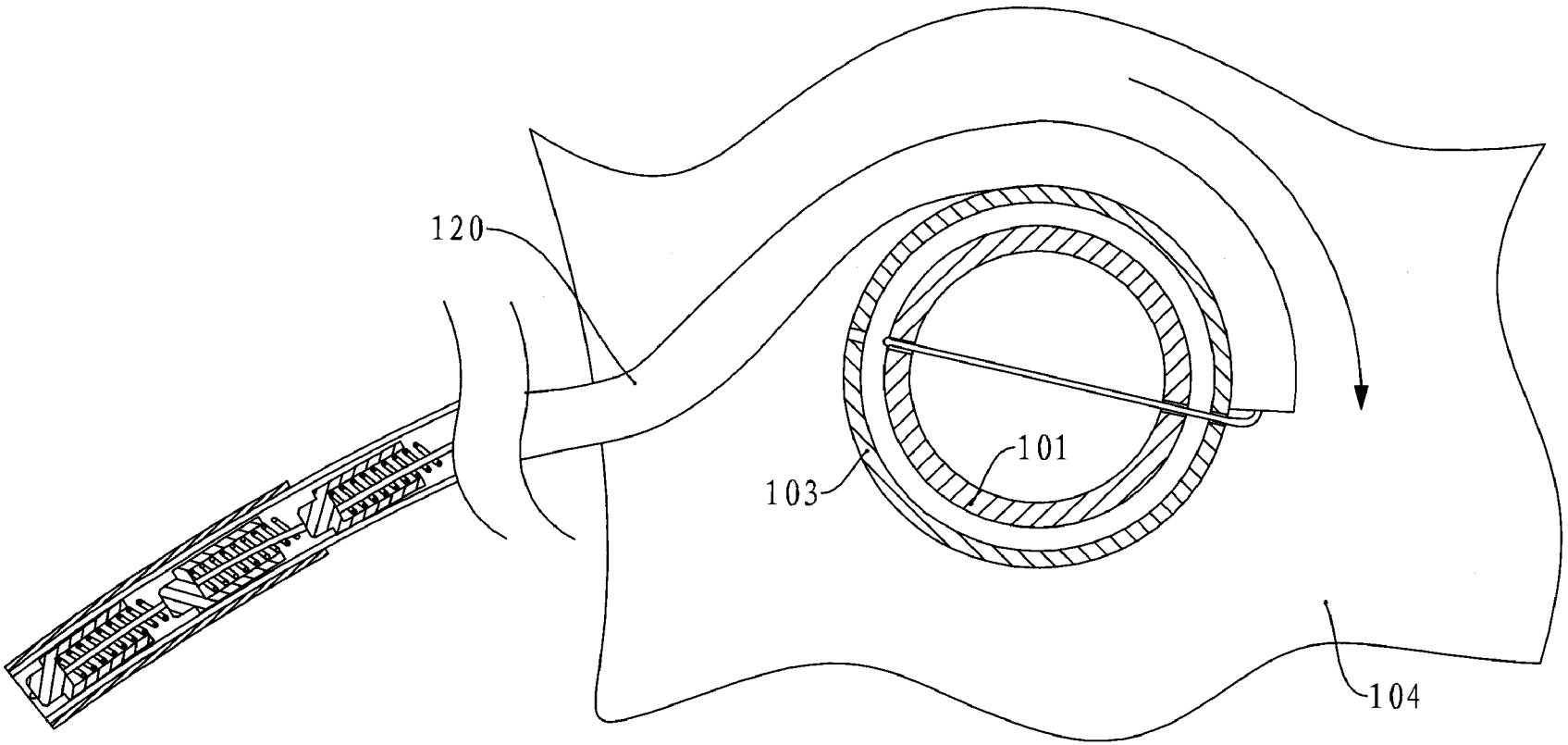
FIG. 20 is a perspective view showing the retraction of the rod of embodiment 2.
Figure 21:
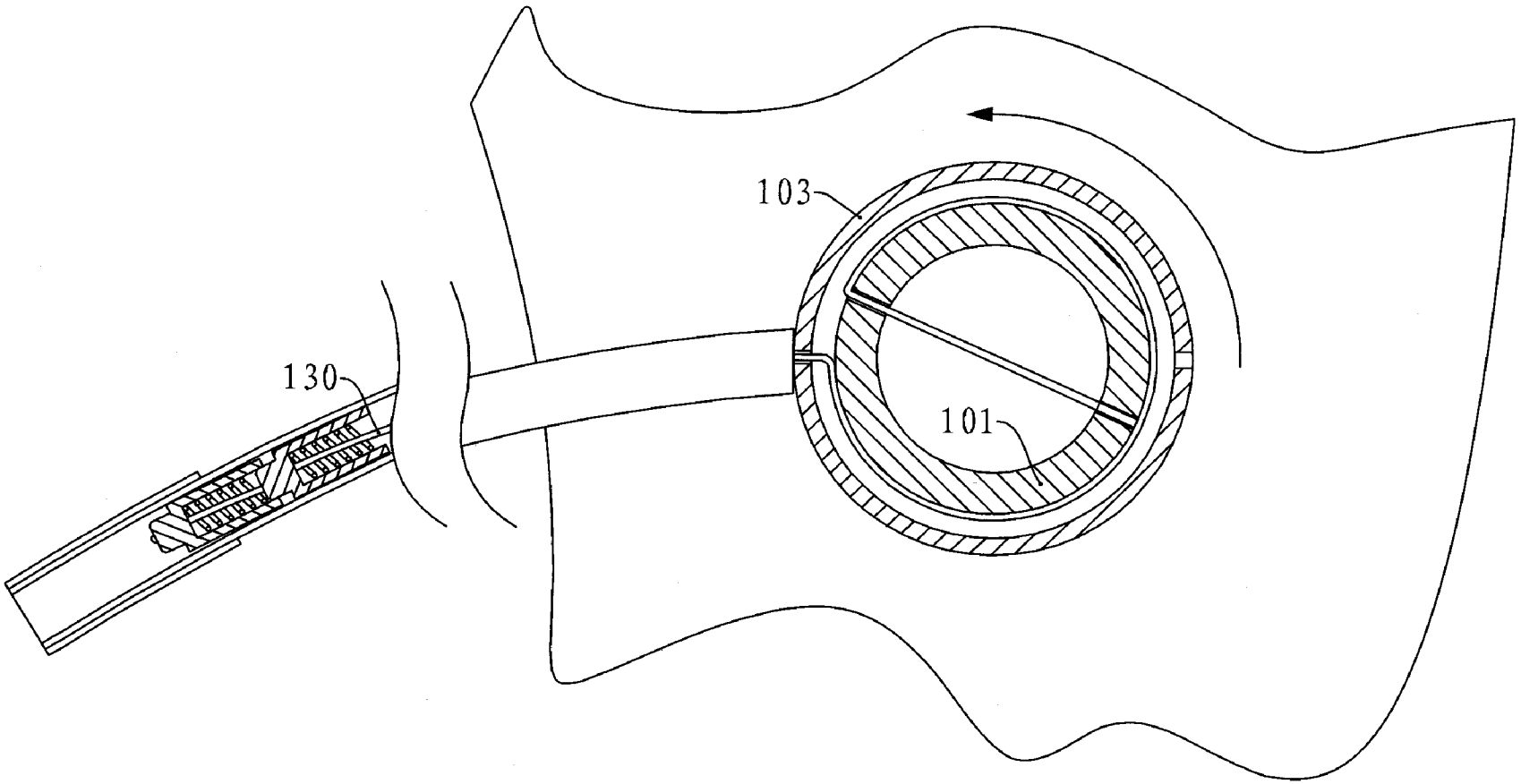
FIG. 21 is a perspective view showing that the rod of embodiment 2 is stretched and becomes rigid.

The following description explains the working mechanism of embodiment 2. See FIG. 20, when shaft 101 and rod storage sleeve 103 are driven by each individual force, they rotate starting from the state of FIG. 4 clockwise by following the arrow indicated in FIG. 20; soft tube 120 and inside rigid joints 110 enter into between two rope-protecting boards 104, and thus the retraction process is complete. The releasing process of the rod is as follows. In the above retracted state, when shaft 101 and rod storage sleeve 103 are driven by each individual force, first, they rotate to the state of FIG. 4 counterclockwise, then, rod storage sleeve 103 stop rotating, shaft 101 continues rotating counterclockwise, which pulls the flexible rope, this forms a rigid rod shown in FIG. 21.

Embodiment 1 of Tents

Figure 22:
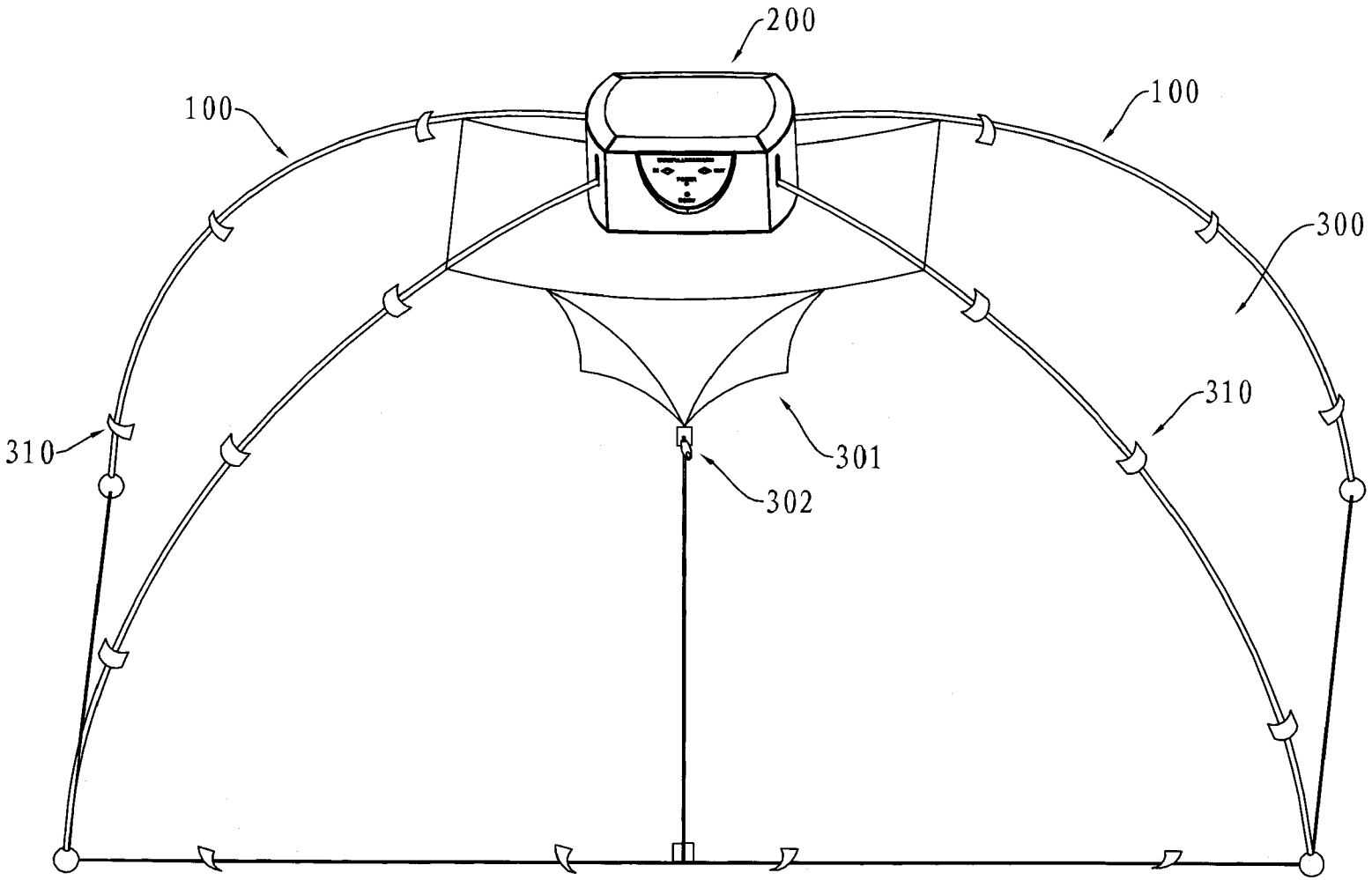
FIG. 22 is a three-dimensional view of the tent embodiment which is open and becomes rigid.

See FIG. 22, the tent of the invention is made by a rigid frame comprising three or more of the retractable rods. This embodiment uses four retractable rods 100; storage compartment is in storage box 200; tarpaulin 300 is linked by rings 310 to the rods 100. Tarpaulin is equipped with a zipper 302 to open or close door 301 to let people in or out.

Figure 23:
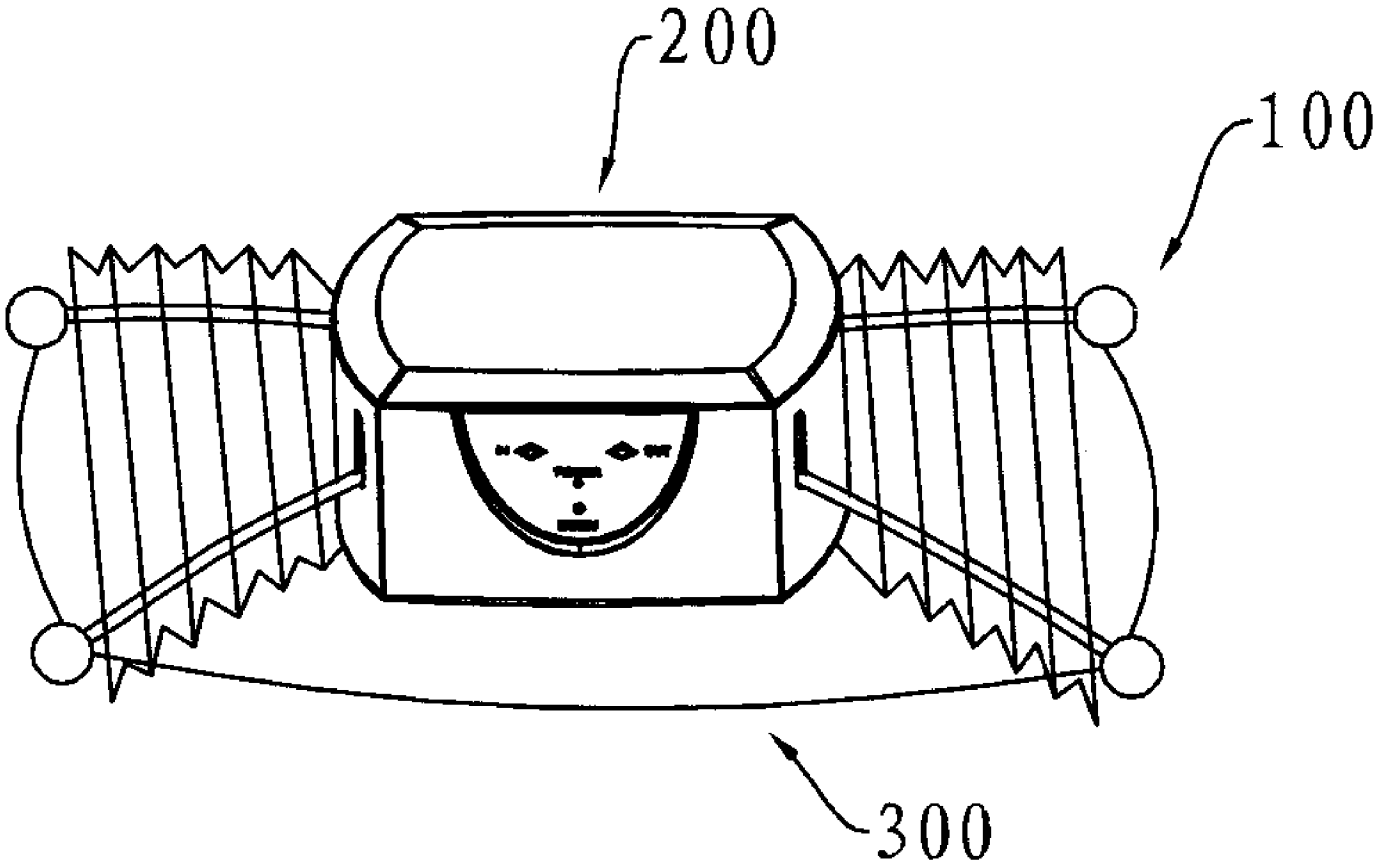
FIG. 23 is a three-dimensional view of the tent embodiment which is retracted and stored.

See FIG. 23, after the tent is retracted as shown in FIG. 22, tarpaulin 300 is folded up inside rigid tube 141; as the tent is retracted, it takes a smaller space to store than the tents known in the art.

Figure 24:
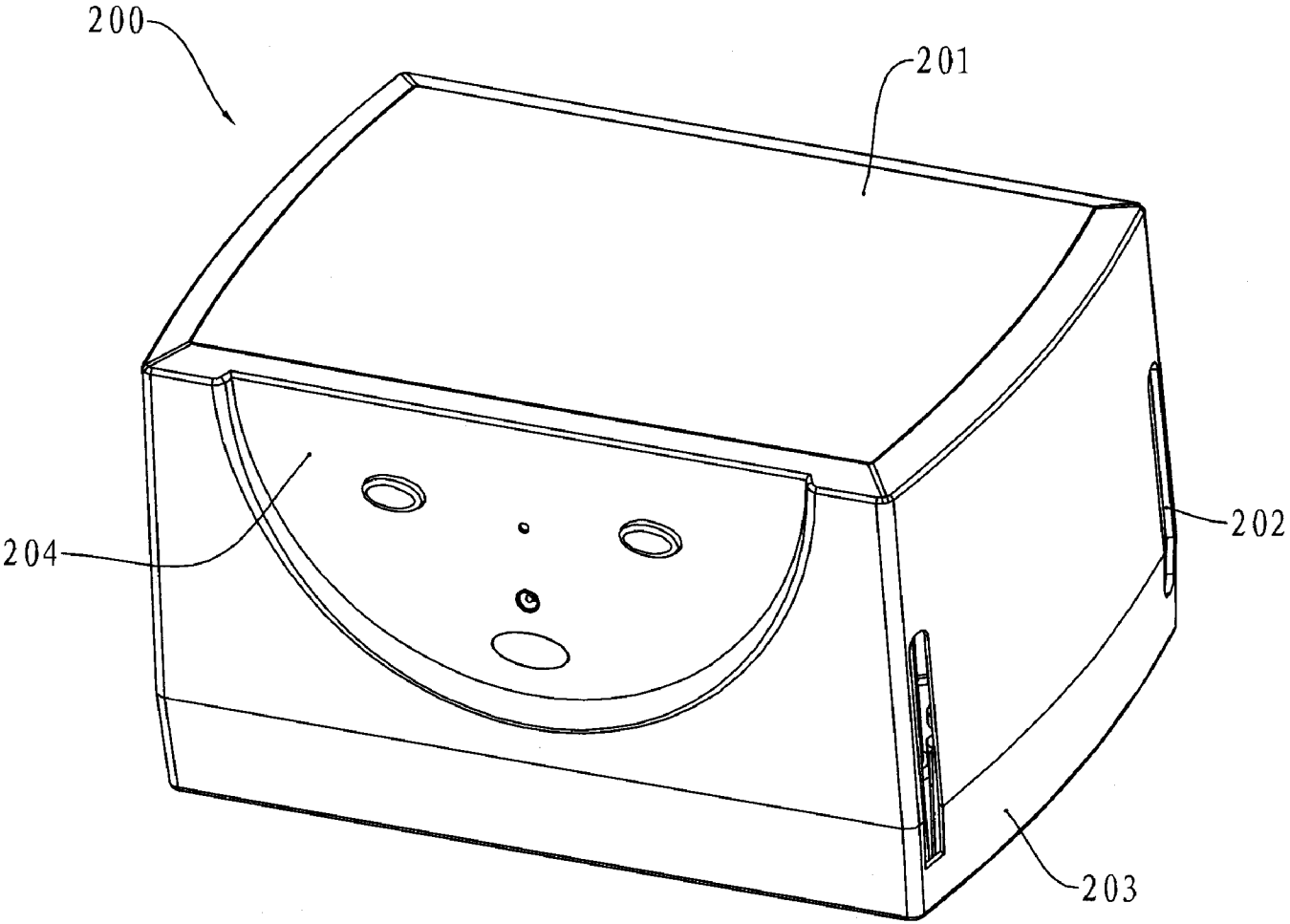
FIG. 24 is a three-dimensional view of the tent embodiment omitting the rods and tent.

The following describes the structure of storage box 200. See FIG. 24, storage box 200 comprises chassis 203, covering 201, and control panel 204. The control panel is provided with a flare, a remote control receiver, and a control push-button, etc. In addition, storage box 200 has holes 202 for the four rods.

Figure 25:
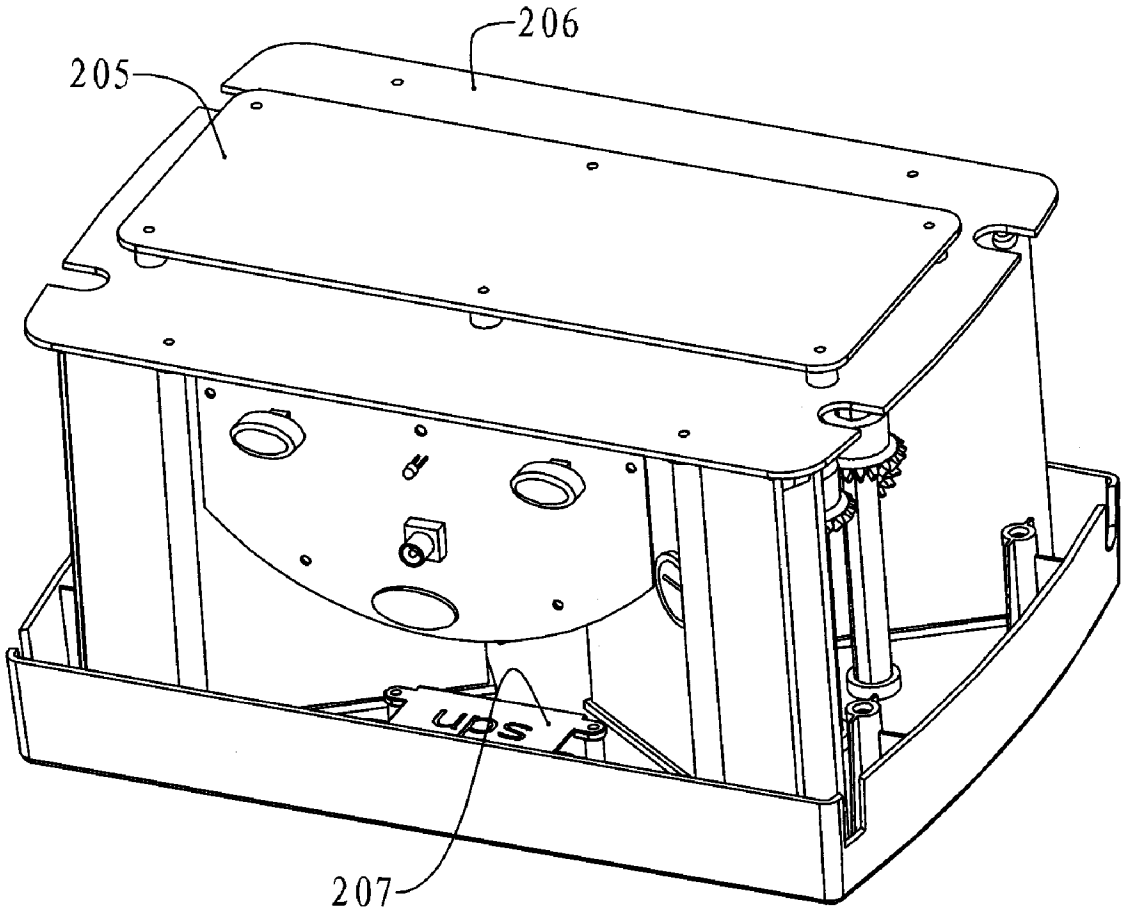
FIG. 25 is a three-dimensional view of FIG. 24 omitting the outer covering.

See FIG. 25, removing cover 201, one can see the top cover 205 and bottom cover 206 which are used to support the gear system; one can also see the battery 207.

Figure 26:
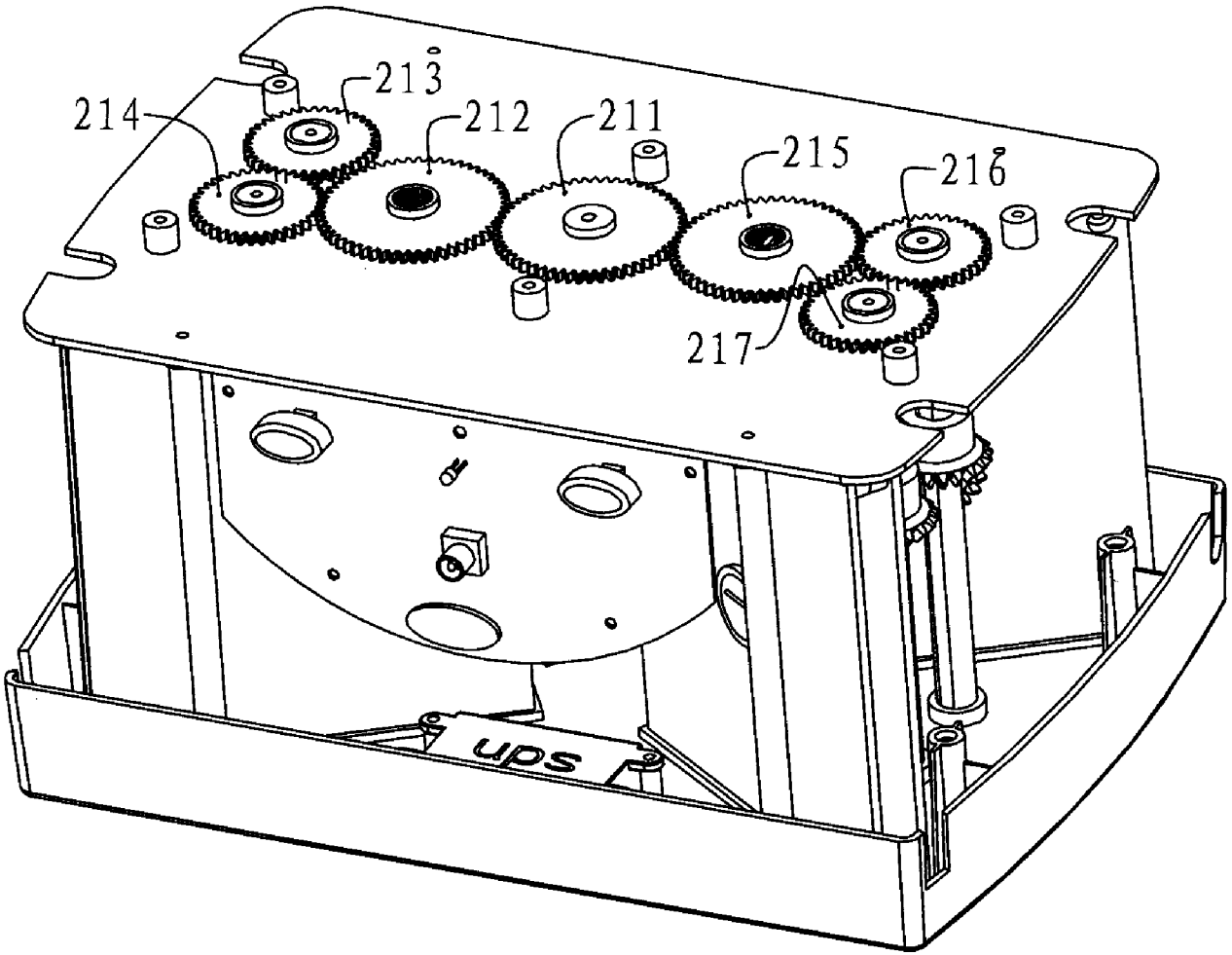
FIG. 26 is a three-dimensional view of FIG. 25 omitting the top cover.

See FIG. 26, removing top cover 205, one can see the gear system; the gear system comprises drive gear 211 which is linked to the power input shaft, idle gears 212 and 215, and gears 213, 214, 216, and 217.

Figure 27:
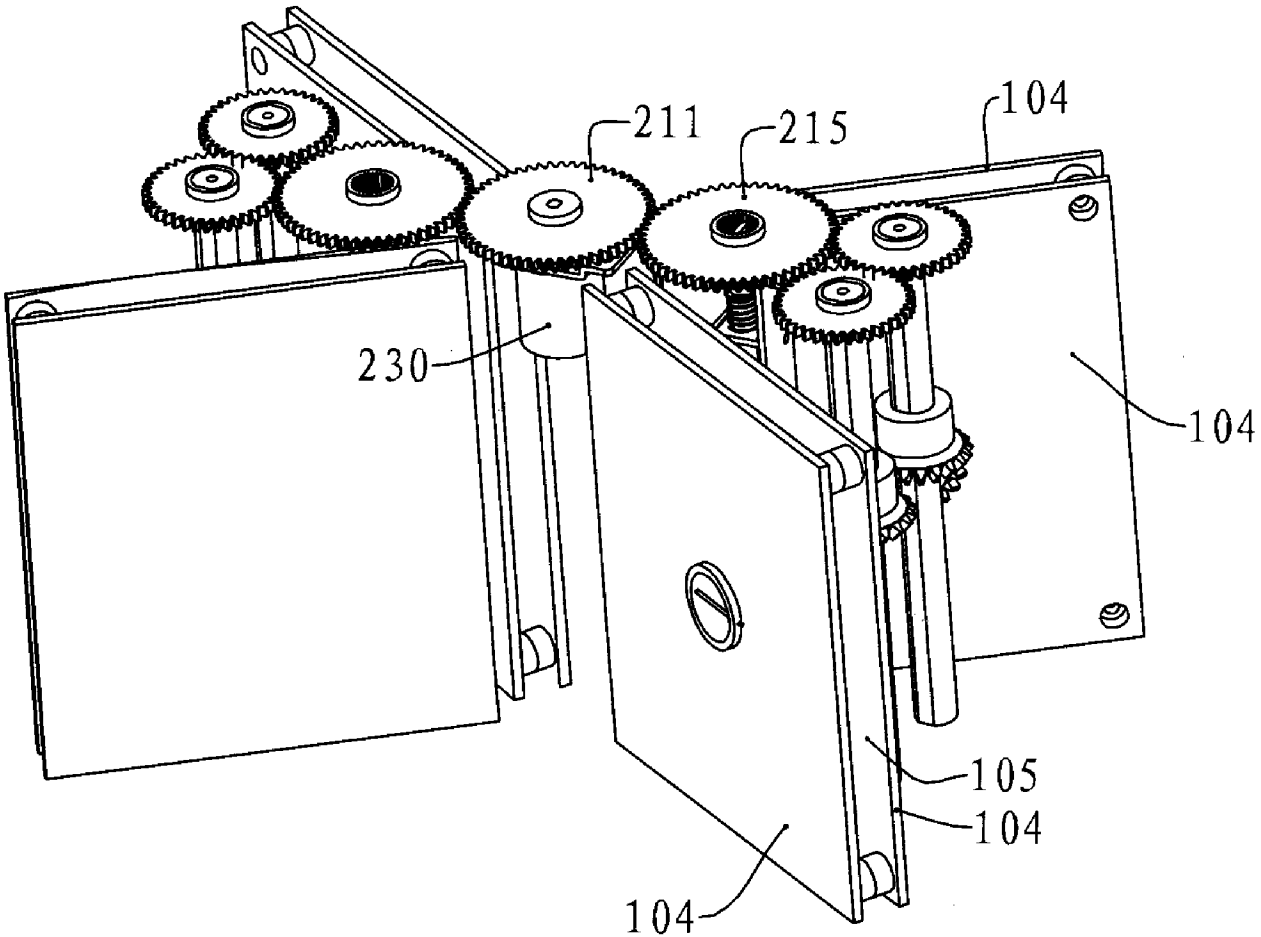
FIG. 27 is a three-dimensional view of FIG. 26 omitting the bottom support and the bottom plate of the transmission system.

See FIG. 27, each retractable rod has two rope-protecting boards 104, which is fixed on storage box 200. To reduce cost, the bearing between the rod storage sleeve and rope-protecting boards can be designed as friction-based hole-cover type rather than ball gears. The width of storage space 105 depends on the length of the rod. The storage space 105 can be designed to store a number of rope circles per level. The power input shaft for drive gear 211 is linked with the power output shaft of motor 230; idle gear 215 is provided with a locking device.

Figure 28:
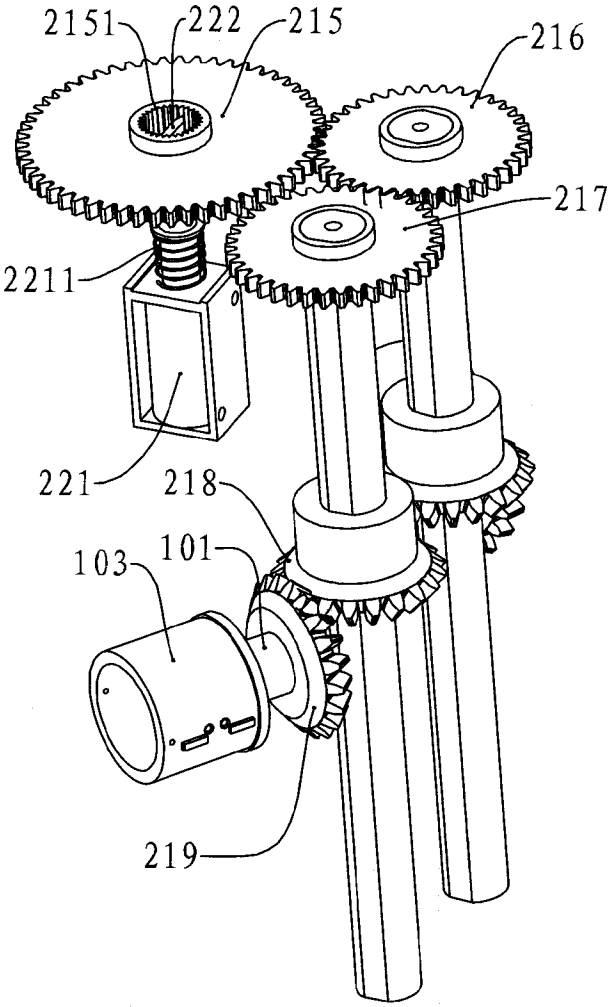
FIG. 28 is an enlarged portion view of FIG. 27 showing the working mechanism of the transmission and locking systems.

See FIG. 28, idle gear 215 meshes with gear 216; gear 216 meshes with gear 217. Gear 217 and bevel gear 218 form twin gear. Gear 218 meshes with another bevel gear 219 which is fixed on shaft 101. Thus, the power transmission of the retractable rod is complete. Other three retractable rods can be designed in the same way so that all four retractable rods will function simultaneously. Magnet 221 has a sheet-shaped locking bar 222. The axis core of idle gear 215 has a vertical socket 2151 for locking bar 222 to insert. Magnet 221 and motor 230 receive or loss power simultaneously. When power is supplied, magnet attracts down locking bar 222, the locker is withdrawn; when power is lost, the resilience of the spring 2211 pushes locking bar 222 to insert in socket 2151; the system is thus locked.

Embodiment 2 of Tents

This embodiment differs from the above embodiment in the inner structure of storage box 200 which is described as follows.

Figure 29:
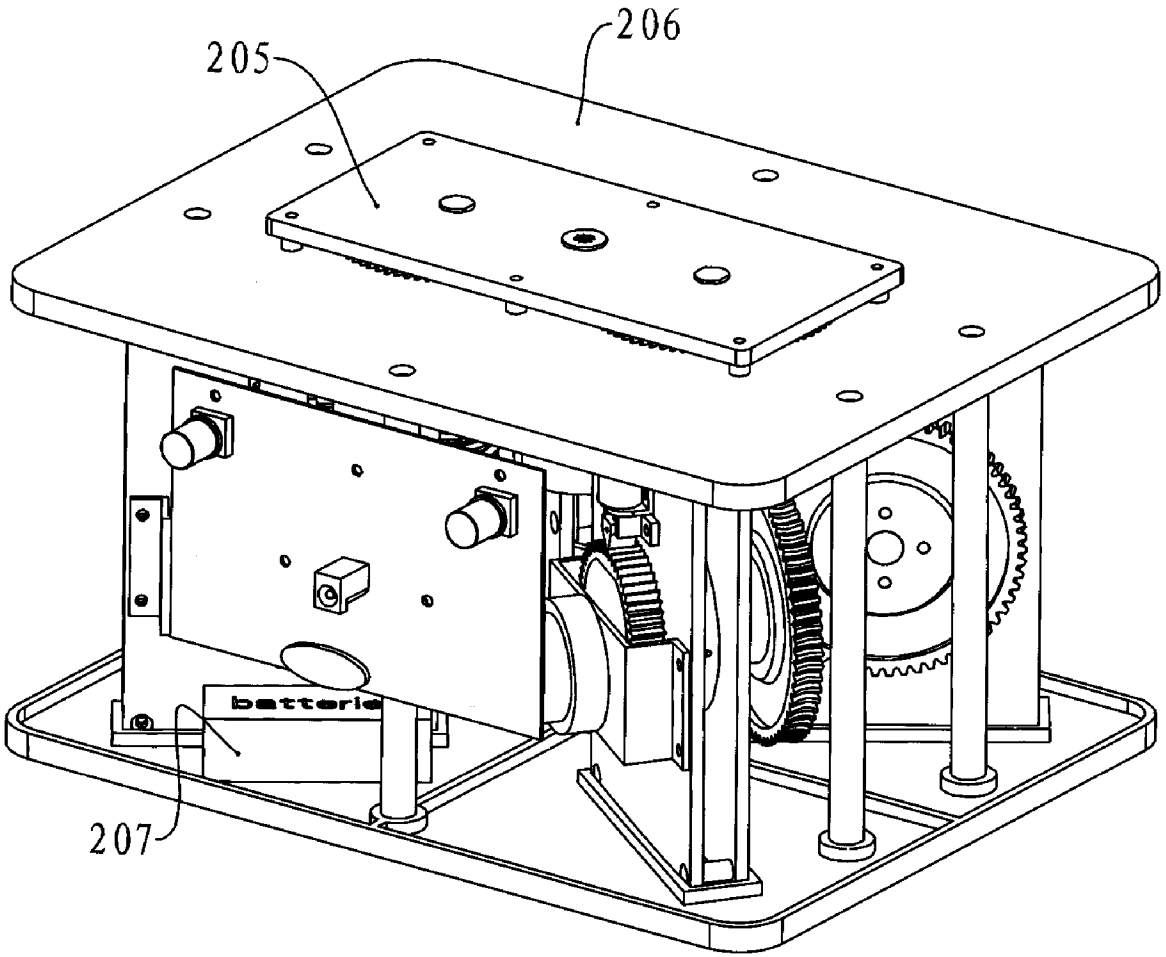
FIG. 29 is a three-dimensional view of an embodiment of another tent omitting the retractable rods, tent and outside cover.

See FIG. 29, removing the covers, one can see top cover 205 and bottom cover 206 which are used to support the gear system. One can also see battery 207.

Figure 30:
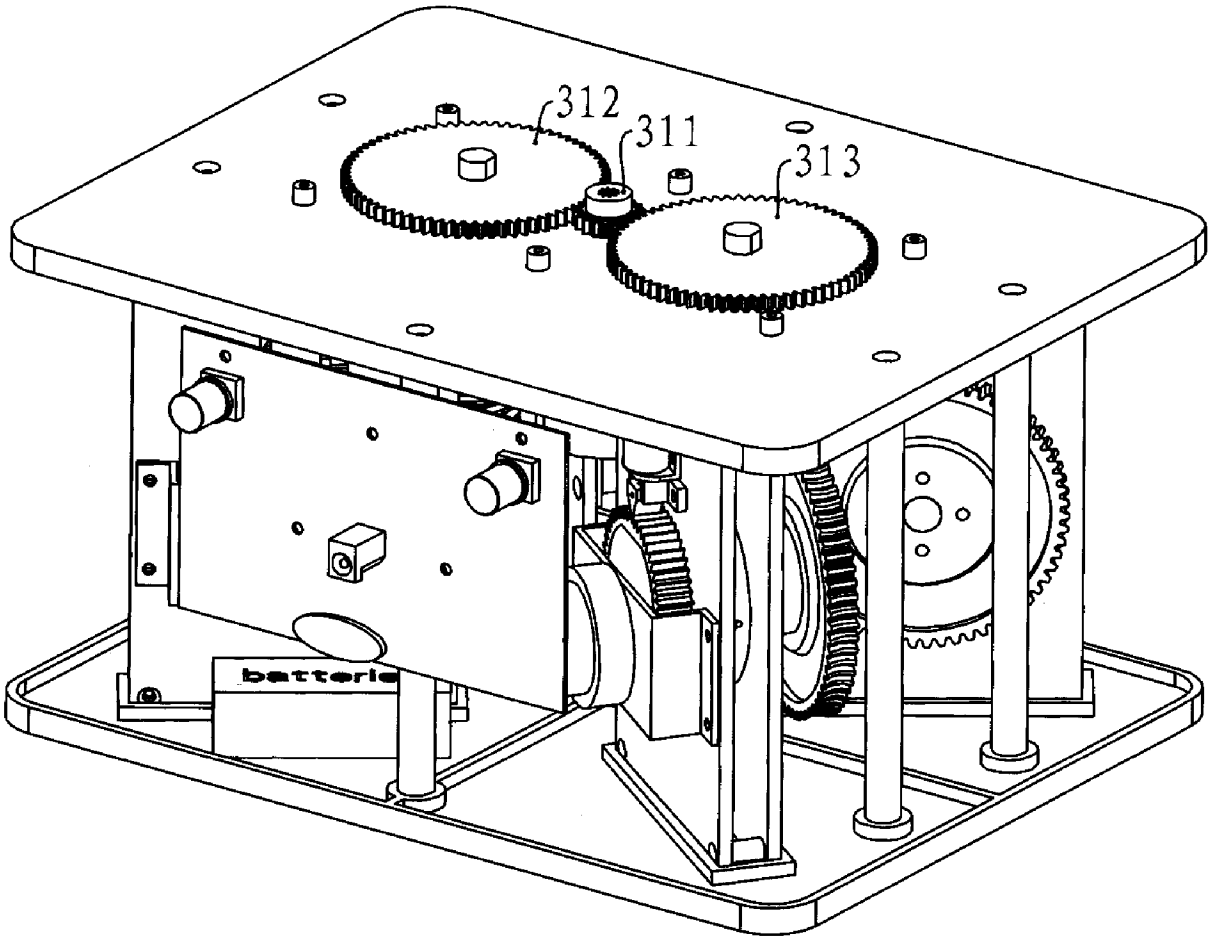
FIG. 30 is a three-dimensional view of FIG. 29 omitting the top cover of the transmission system.

See FIG. 30, removing top cover 205, one can see the gear system which include drive gear 311 which linked to the power input axis, gears 312 and 313, and worm bearing adjuster (not shown in the figure).

Figure 31:
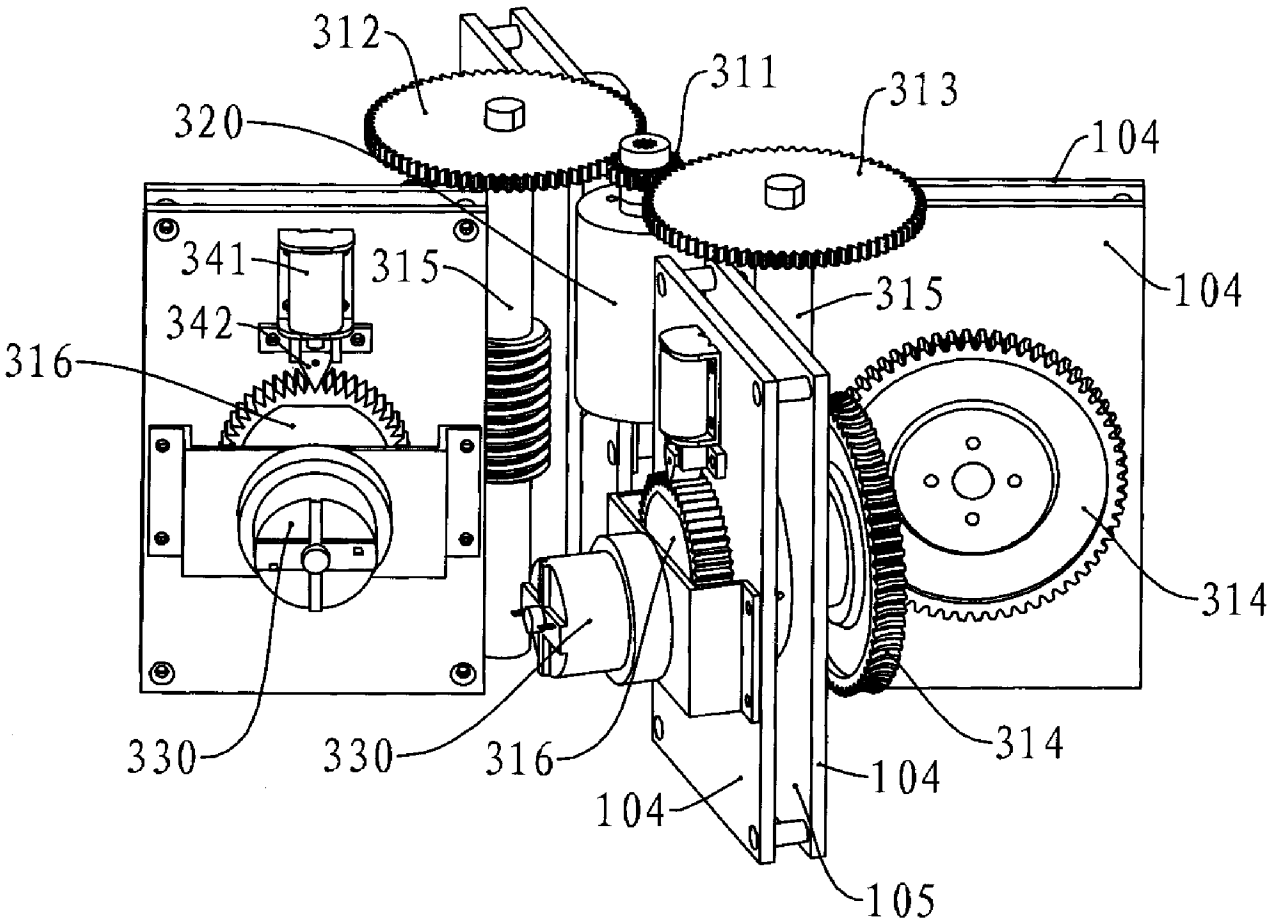
FIG. 31 is a three-dimensional view of FIG. 30 omitting the bottom support and the bottom plate of the transmission system.

See FIG. 31, there are four retractable rods; each retractable rod has two rope-protecting boards 104. The structure of the rods is the same as the rod in embodiment 2. The rods are fixed inside storage box 200. Rod storage sleeve 103 extends to the end of rope-protecting boards 104 (see FIG. 3) which is equipped with gear 314; two gears 314 mesh with worm bearing adjuster 315. Thus, motor 320 drives the four retractable rods and rod storage sleeves 103 to rotate simultaneously. Shafts 101 of the four retractable rods extend outside the end of rope-protecting boards 104 which is equipped with gears 316. Each gear 316 is fixed to the power output axis of motor 330. Thus, each shaft 101 is provided with power. The locking device comprises magnet 341 and locking bar 342. Driven by magnet 341, locking bar 342 insert into or pull out of the space between the teeth of gear 316 to lock or unlock the shafts. The width of storage space 105 depends on the length of the rod. The storage space 105 can be designed to store a number of rope circles per level.

INDUSTRIAL UTILITIES

The invention uses a flexible rope to connect rigid skeleton joints to form a rod. When the rope is stretched, the convex of each skeleton joint tightly pushes against the concave of the adjacent skeleton joint to form a rigid rod. When the rope is relaxed, the convex-concave connection loosens; adjacent joints can move relative to each other to form angles; the rod thus becomes flexible and can be folded up or coiled. The objective of the invention is that the operation for exchange between the flexible state and the rigid state of the rod is simple and rod in flexible state can be orderly organized and stored. Thus, a storage compartment is set at one end of the rod. The storage compartment comprises a rod storage sleeve driven by a shaft and two flexible ropes, one end of which passes through the rod storage sleeve and is then fixed to the shaft. The rod storage sleeve is supported and rotates between the rope-protecting boards. When the shaft drives the rod storage sleeve to rotate, the rod can coil around the rod storage sleeve and be stored between the rope-protecting boards. At the other end of the shaft, there is a tension part. On one side, this allows the relaxed rod to be coiled and stored inside the rod storage sleeve. On the other side, this makes the operation simple. Because the tension part and the tension quantity equals to the arc length the shaft idled, this ingeniously resolves the flexible-rigid exchange issue. At the same time, this makes the flexible-rigid exchange simple.

What is claimed is:

1. A retractable rod, comprising:

a multitude of rigid skeleton joints having two axial end surfaces and side surfaces;

each of the joints having a convex at one axial end surface and a concave at the other axial end surface which meshes with the convex;

each of the joints having two holes through the axial end surfaces;

all of the joints being connected through the convex-concave connection by two flexible ropes passing through the holes of the joints to form a rod;

the rod being characterized by:

a storage compartment locating at one end of the rod and winding and storing the rod therein; the storage compartment comprising a shaft, a rod storage sleeve which is in an intermittent drive mode fixed to the shaft; one end of the two flexible ropes passing through the rod storage sleeve and being fixed to the shaft; the rod storage sleeve being supported and rotating between two rope-protecting boards;

a tension part locating at the other end of the rod; and the other end of the two flexible ropes being fixed to the tension part.

2. The retractable rod of claim 1, wherein the rod storage sleeve and the shaft are connected by gears.

3. The retractable rod of claim 1, wherein the tension part comprises a supporting leg and an elastic component which links between the supporting leg and the other end of the two flexible ropes.

4. The retractable rod of claim 1, wherein two end surfaces of some of the rigid skeleton joints forms an angle, and the spool thread of the convex and concave is vertical to the end surfaces.

5. A retractable rod, comprising:

a multitude of rigid skeleton joints having two axial end surfaces and side surfaces;

each of the joints having a convex at one axial end surface and a concave at the other axial end surface which meshes with the convex;

each of the joints having two holes through the axial end surfaces;

all of the joints being connected through the convex-concave connection by two flexible ropes passing through the holes of the joints to form a rod;

the rod being characterized by:

a storage compartment locating at one end of the rod and winding and storing the rod therein; the storage compartment comprising a shaft, a rod storage sleeve which is in a relative rotation way set outside the shaft; one end of two or more flexible ropes passing through the rod storage sleeve and being fixed to the shaft; the rod storage sleeve being supported and rotating between two rope-protecting boards.

6. The retractable rod of claim 5, wherein there is an elastic component between the convex and concave of two adjacent joints.

7. The retractable rod of claim 6, wherein the elastic component is a spring.

8. The retractable rod of claim 5, wherein two end surfaces of some of the rigid skeleton joints forms an angle, and the spool thread of the convex and concave is vertical to the end surfaces.

9. A tent comprising the retractable rod of claim 1, said tent comprising a tarpaulin to form a tent space; and three or more of the retractable rods to support the tent space;

wherein the tarpaulin is fixed to the rods and is retractable with the rods.

10. The tent of claim 9, further comprising a power input shaft which links to the retractable rods through a transmission system.

11. The tent of claim 10, wherein the power input shaft links to a power output shaft of a motor and the gear system is provided with a locking device to lock the transmission system.

12. The tent of claim 11, wherein the locking device comprises a locking bar driven by a magnet and locking teeth surrounding a gear shaft and wherein the tallying if the locking bar and locking teeth is controlled by the magnet.

13. The tent of claim 9, further comprising a control panel which is equipped with a flare and a remote control receiver.

14. A tent comprising the retractable rod of claim 5, said tent comprising a tarpaulin to form a tent space; and three or more of the retractable rods to support the tent space;

wherein the tarpaulin is fixed to the rods and is retractable with the rods.

15. The tent of claim 14, further comprising a power input shaft driven by a motor (320); wherein the power input shaft links through a transmission system with the rod storage sleeve of the retractable rod and wherein one motor (330) drives one shaft.

16. The tent of claim 15, wherein each shaft has a gear (316) and a locking device to lock the gear (316).

17. The tent of claim 16, wherein the locking device comprises a locking bar driven by a magnet and wherein the tallying of the locking bar and locking teeth of the gear (316) is controlled by the magnet.

18. The tent of claim 14, further comprising a control panel which is equipped with a flare and a remote control receiver.

* * * * *